US010174505B1

(12) United States Patent
Hicks et al.

(10) Patent No.: US 10,174,505 B1
(45) Date of Patent: Jan. 8, 2019

(54) ROOFING DEBRIS COLLECTION APPARATUS

(71) Applicants: Heath Austin Hicks, Tyler, TX (US); Eric James Mackintosh, Tyler, TX (US)

(72) Inventors: Heath Austin Hicks, Tyler, TX (US); Eric James Mackintosh, Tyler, TX (US)

( * ) Notice: Subject to any disclaimer, the term of this patent is extended or adjusted under 35 U.S.C. 154(b) by 0 days.

(21) Appl. No.: 15/944,687

(22) Filed: Apr. 3, 2018

(51) Int. Cl.

| | |
|---|---|
| ***E04D 13/00*** | (2006.01) |
| ***B65F 1/00*** | (2006.01) |
| ***E04D 13/076*** | (2006.01) |
| ***E04D 13/068*** | (2006.01) |
| *E04D 13/072* | (2006.01) |

(52) U.S. Cl.
CPC ..... *E04D 13/076* (2013.01); *E04D 13/068* (2013.01); *B65F 1/0006* (2013.01); *E04D 13/0727* (2013.01)

(58) Field of Classification Search
CPC . E04D 13/076; E04D 13/068; E04D 13/0727; B65F 1/0006
See application file for complete search history.

(56) References Cited

U.S. PATENT DOCUMENTS 2,271,081 A * 1/1942 Layton ..... E04D 13/076 210/474
3,023,544 A * 3/1962 Hughes ..... E04D 13/076 52/12
3,352,581 A 11/1967 Robbins et al.
3,913,284 A * 10/1975 Hall ..... E04D 13/0645 405/119
4,190,988 A * 3/1980 Carreiro ..... E04D 13/064 52/11
4,406,093 A * 9/1983 Good ..... E04D 13/064 52/11
5,564,234 A * 10/1996 Vermeulen ..... A01G 9/242 52/63
6,113,340 A 9/2000 Zalal
7,303,687 B2 12/2007 Groth et al.
8,166,712 B2 5/2012 Contreras
9,033,349 B2 5/2015 Graves et al.
9,359,139 B1 6/2016 Faulkner
9,555,968 B2 1/2017 Seaton
2005/0016076 A1* 1/2005 Spradlin ..... E04D 13/0641 52/11
2008/0010906 A1* 1/2008 Brochu ..... E04D 13/076 52/12

* cited by examiner

*Primary Examiner* — Jeanette E Chapman
(74) *Attorney, Agent, or Firm* — Gerald M. Walsh; Lanier Ford Shaver & Payne P.C.

(57) ABSTRACT

A roofing debris collection apparatus having one or more gutter liners constructed to fit in an interior of a gutter to collect roofing debris; one or more debris chute drapes; and one or more drape support poles to maintain the debris chute drapes in a vertical angled orientation adjacent the gutter to guide roofing debris from a roof to the ground. Roofing debris is allowed to accumulate in the gutter liners or to fall off the roof on to the debris chute drapes and to slide from the debris chute drapes onto a tarp on the ground. The roofing debris is collected and removed by collecting the gutter liners from the gutter and gathering the tarp from the ground. The roofing debris collection apparatus allows for rapid collection and removal of roofing debris and protects the sides of a building from any damage that might be caused by the collection of roofing debris.

23 Claims, 8 Drawing Sheets

ROOFING DEBRIS COLLECTION APPARATUS

FIELD OF THE INVENTION

This invention relates to the field of facilitating removal of roof materials and in particular to a new and useful gutter liner and drape chute system for safely and efficiently delivering materials and debris from roof structures.

BACKGROUND OF THE INVENTION

In the roofing trades, it is often necessary to completely remove an existing roof structure prior to replacement with a new roof. This procedure involves the tear off and removal of the roof materials such as asphalt coatings, shingles, roofing paper, asbestos, plywood and other materials, which must be delivered to a dump truck at ground level for disposal. If these materials are simply dropped off the side of the roof they can damage the side of the building or damage other structures such as shrubs, flowers, and bushes. In conventional practice a collection bin is placed on the roof or various chute systems have been devised to remove debris from the roof surface and deliver it to a dump truck. However, such conventional systems have inherent drawbacks and are difficult to manage. Collection bins have to be hoisted onto the roof and moved to different areas of the roof. Likewise chutes that extend from the edge of the roof to the ground have to be moved from position to position around the perimeter of the roof. An easier and quicker system would be an apparatus that allowed discarding of debris into the gutters and over the edge of the roof which, at the same time, was safe and provided an efficient collection of the debris.

SUMMARY OF THE INVENTION

The present invention is roofing debris collection apparatus having one or more gutter liners, one or more debris chute drapes, and one or more drape support poles maintaining the debris chute drapes in a vertical orientation adjacent the gutter. The gutter liner has a U-shaped or V-shaped lip on a top of the gutter liner. The U-shaped or V-shaped lip is constructed to fit over a top edge of a gutter. The drape support poles have a pole tip support for engaging the side of a building. The pole tip support has a support portion having a pole connecting portion and a debris chute drape connecting portion. The pole tip support also has a protective cover.

In an alternant embodiment of the gutter liner the gutter liner is adjustable, having a first portion with a U-shaped or V-shaped lip on a top of said first portion and having a second portion with a U-shaped or V-shaped lip on a top of the second portion. The second portion is adjustably inserted into the first portion and the U-shaped or V-shaped lip on the second portion fits over the U-shaped or V-shaped lip on the first portion.

In another alternate embodiment gutter liner has a plurality of spaced apart debris collecting cups. The debris collecting cups are attached to a first side of a U-shaped or V-shaped lip. An opposite side of the lip is constructed to fit over a front side of a gutter.

In another alternant embodiment of the gutter liner the gutter liner has a U-shaped or V-shaped lip extending from a front side and from a top of the gutter liner. The gutter liner has one or more connectors positioned in an interior of the gutter liner on the front side for connecting to a debris chute drape.

The gutter liners of the present invention can be used adjacent to a gutter cover for directing roofing debris from a roof, over a gutter, and directly onto a debris chute drape. The gutter cover consists of a cover plate and brace member on its bottom surface.

The invention provides a method for collecting roofing debris, comprising the steps of inserting one or more gutter liners into a gutter attached to a roof; positioning one or more debris chute drapes vertically on one or more poles adjacent the gutter; allowing roofing debris to accumulate in the one or more gutter liners or to fall on to one or more debris chute drapes and to fall from the one or more debris chute drapes onto the ground; and collecting the roofing debris from the gutter liners and from the ground. The invention also provides a kit for collecting roofing debris. The kit has one or more gutter liners constructed to fit in an interior of a gutter; one or more debris chute drapes; and one or more drape support poles for maintaining the debris chute drapes in a vertical orientation adjacent the gutter. The kit can also include a gutter cover and a debris collection tarp with handles.

An advantage of the present invention is a roofing debris collection apparatus that can be rapidly installed around the perimeter of a roof.

Another advantage is a roofing debris collection apparatus that is compact, easy to transport and assemble, and inexpensive to construct.

Another advantage is a roofing debris collection apparatus that allows for rapid collection and removal of roofing debris.

Another advantage is a roofing debris collection apparatus that protects the sides of a building from any damage that might be caused by the collection of roofing debris.

Another advantage is a debris chute drape made of netting that allows air exchange.

Another advantage is a debris collecting tarp having handles to facilitate lifting and carrying the tarp when it is full of roofing debris.

DETAILED DESCRIPTION OF THE INVENTION

While the following description details the preferred embodiments of the present invention, it is to be understood that the invention is not limited in its application to the details of construction and arrangement of the parts illustrated in the accompanying figures, since the invention is capable of other embodiments and of being practiced in various ways.

Figure 1:
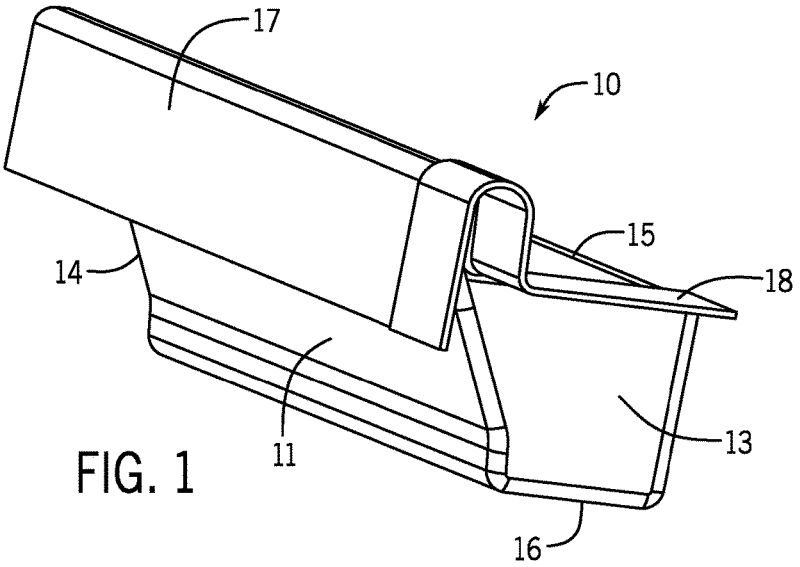
FIG. 1 shows a front perspective view of a gutter liner of the present invention.
Figure 2:
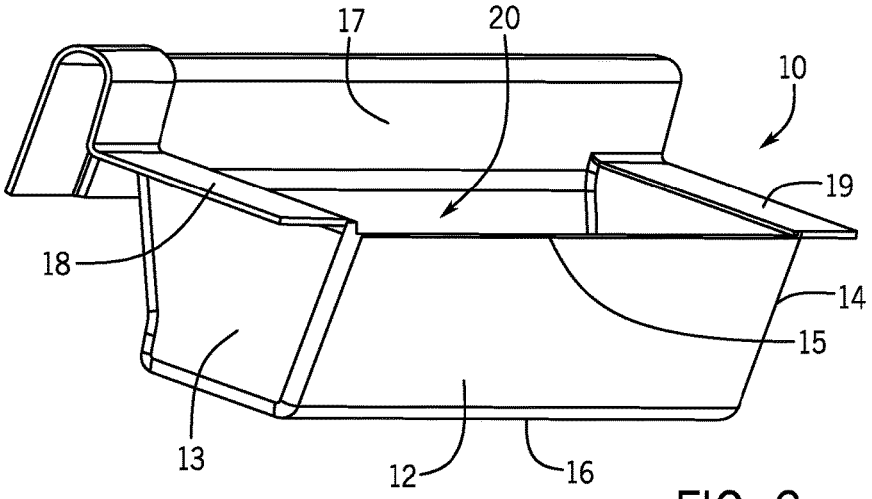
FIG. 2 shows a rear perspective view of the gutter liner.

FIG. 1 shows a front perspective view of a gutter liner 10 of the present invention. The gutter liner 10 has a front side 11, a rear side 12 (see FIG. 2), a first end 13, a second opposite end 14, a top 15 and a bottom 16. A lip 17, preferably a U-shaped or V-shaped lip, extends from the front side 11, top 15 of gutter liner 10. FIG. 2 shows a rear perspective view of the gutter liner 10. The gutter liner 10 has a support member 18 on a first end of the gutter liner 10 and a support member 19 on a second opposite end of the gutter liner 10. FIG. 2 further shows an interior 20 of the gutter liner 10.

Figure 3:
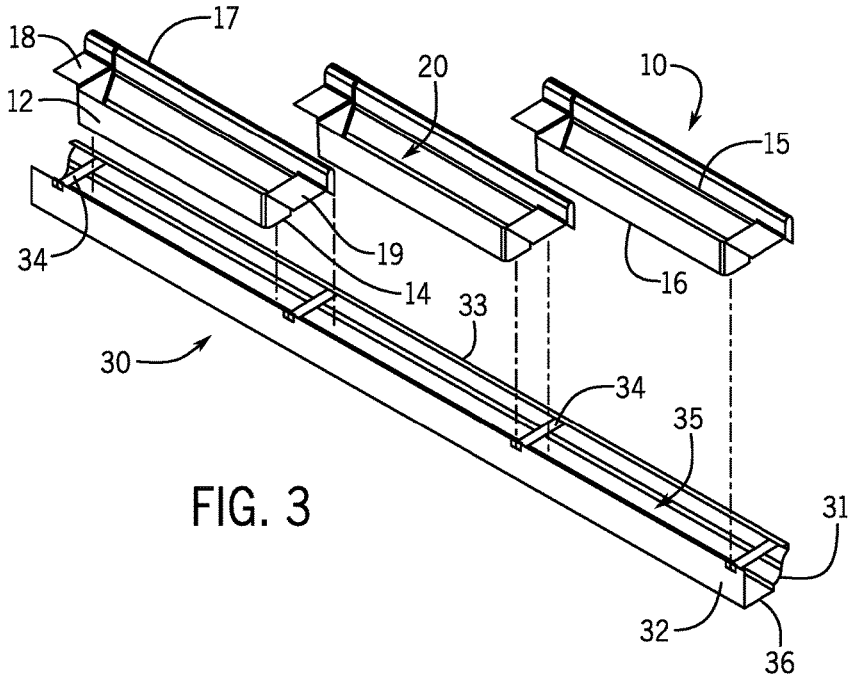
FIG. 3 shows a rear perspective view of a plurality of gutter liners positioned over a gutter.
Figure 4:
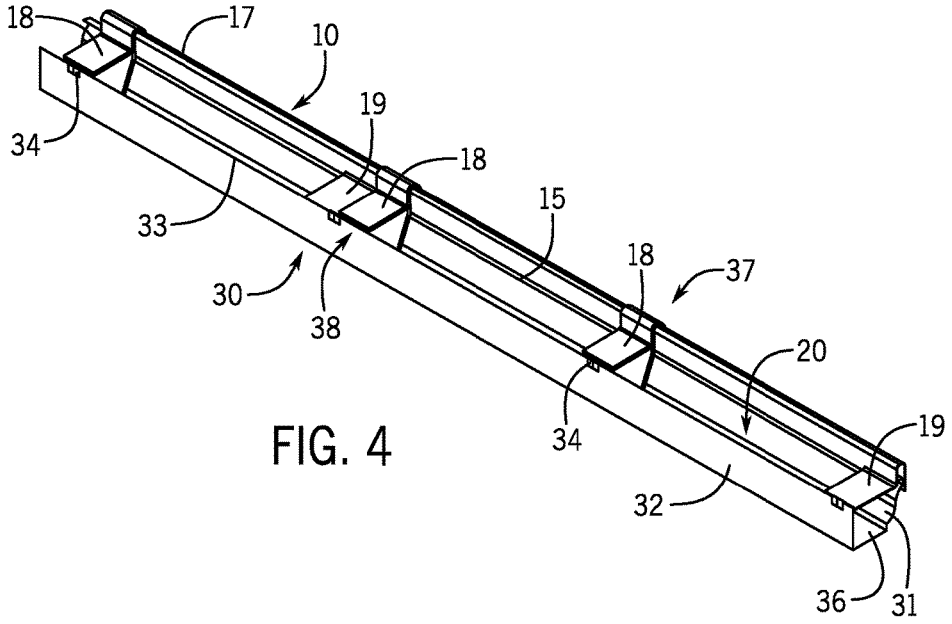
FIG. 4 shows a rear perspective view of the plurality of gutter liners positioned in the gutter.

FIG. 3 shows a rear perspective view of a plurality of gutter liners 10 positioned over a gutter 30. The gutter 30 has a front side 31, a rear side 32, a top edge 33, a bottom 36, and an interior 35. The gutter 30 also has mounting straps 34 which fasten the gutter 30 to a roof. FIG. 4 shows a rear perspective view of the plurality of gutter liners 10 inserted into the interior 35 of gutter 30. The lips 17 of the gutter liners 10 are configured to fit over the front side 31, top edge 33 of the gutter 30. The support members 18 and 19 are configured to fit over the mounting straps 34 and the support member 18 is configured to fit over the support member 19 or adjacent to it. At position 37 the support member 18 is positioned over the support member 19 which is positioned over a mounting strap 34. At position 38 the support member 18 is adjacent to or partially overlaps the support member 19. The support members 18 and 19 may also extend over the rear side 32, top edge 33 of the gutter 30. When the gutter liners 10 are inserted into the interior 35 of gutter 30 they are in position to receive debris from a roof.

Figure 5:
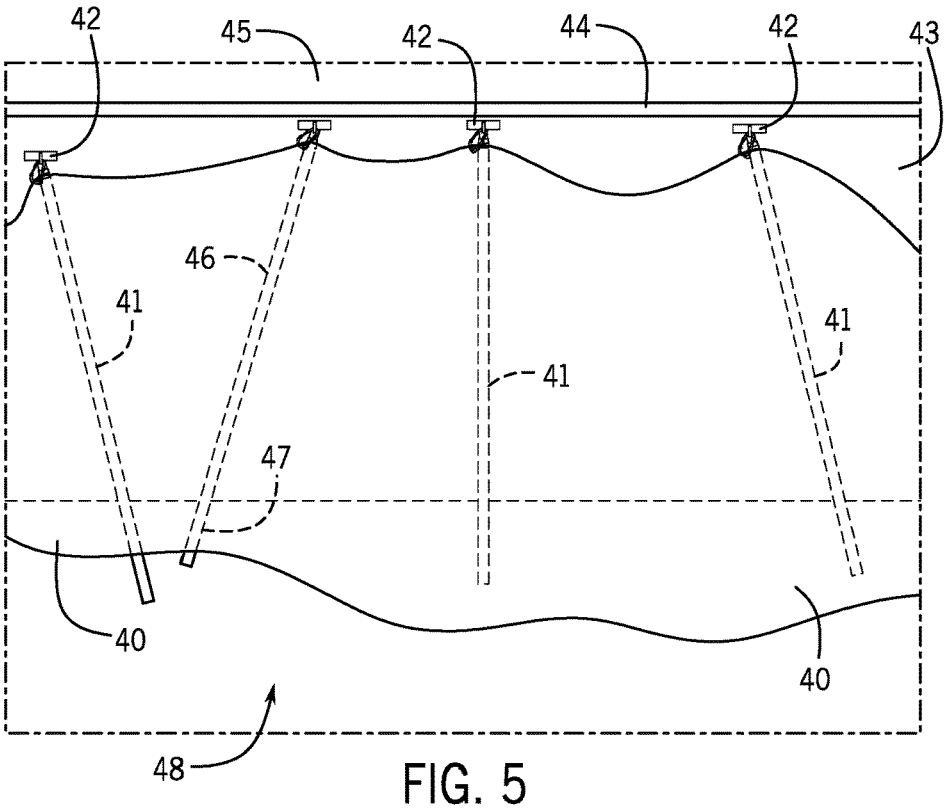
FIG. 5 illustrates debris chute drapes of the present invention positioned on drape support poles adjacent to a gutter on a roof.

FIG. 5 illustrates debris chute drapes 40 of the present invention positioned on drape support poles 41 adjacent to a gutter 44 on a roof 45. The drape support poles 41 have a top end 46 and a bottom end 47. The top end 46 has a pole tip support 42 (topper) that engages the side of a house 43. The pole tip support 42 maintains the position of the top end 46 of the drape support poles 41 against the side of the house 43. The drape support poles 41 are positioned vertically at an angle against the side of the house 43 and the bottom end 47 of the drape support pole 47 engages a debris collection tarp 48 on the ground. The debris chute drapes 40 are connected to the pole tip supports 42, are draped across the drape support poles 41 vertically at an angle, and extend towards the debris collection tarp 48 so as to act as a chute. The debris collection tarp 48 can have handles 49 (see FIG. 10) to facilitate lifting and carrying the debris collection tarp 48 for debris disposal.

The debris chute drapes 40 can be made of any suitable materials known in the art. The debris chute drapes 40 can be made of flexible plastic, textile, or netting material such that roofing debris will slide down the debris chute drapes 40 as it would, for example, down a chute. Preferably, the debris chute drapes 40 are made of a netting design that allows the passage of air. This feature is particularly beneficial when the drapes 40 are placed over plants. The drape support poles 41 can be extendable and retractable (variable length) and can be made of plastic, metal, or wood, or a combination thereof.

Figure 6:
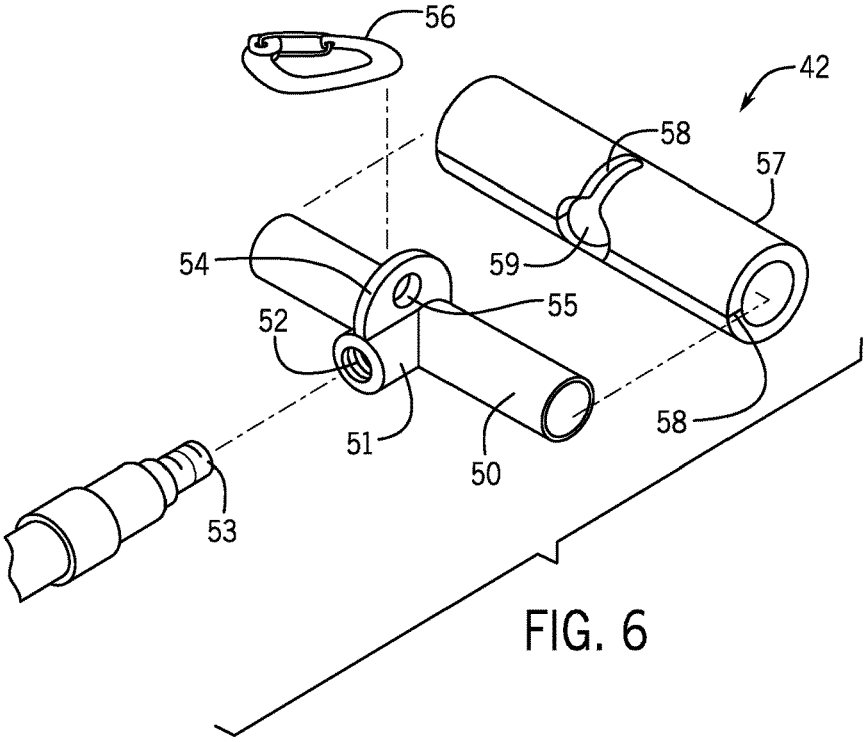
FIG. 6 shows an exploded perspective view of a pole tip support of the present invention.
Figure 7:
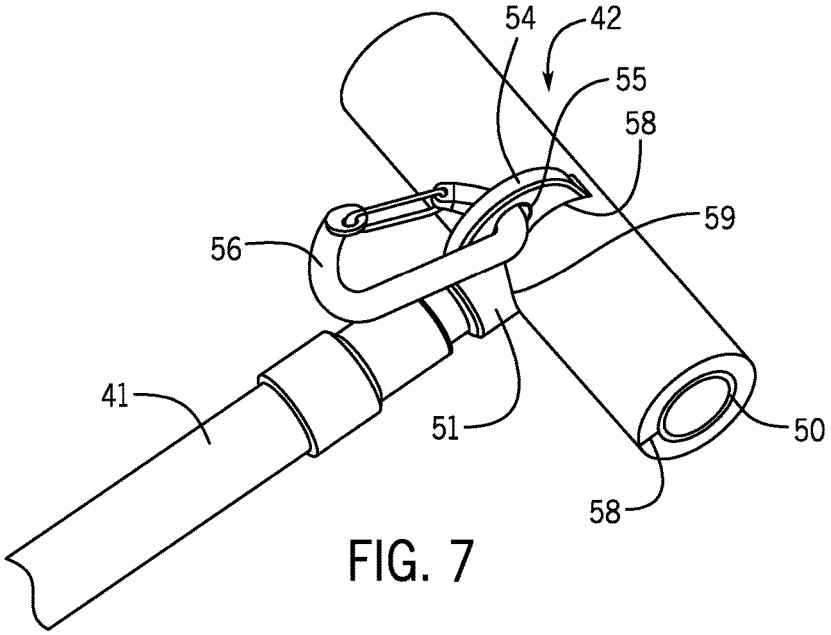
FIG. 7 shows an assembled perspective view of the pole tip support.

FIG. 6 shows an exploded perspective view of a pole tip support 42. The pole tip support 42 has a support portion 50, a pole connecting portion 51, a debris chute drape connecting portion 54. The support portion 50 is shown as a cylinder with the cylindrical pole connecting portion 51 being oriented perpendicular to the support portion 50. The pole connecting portion 51 has internal threads 52 for connection to external threads 53 on the drape support pole 41. A drape chute connecting portion 54 extends from the support portion 50 and the pole connecting portion 51. The drape chute connecting portion 54 has a hole 55 for holding a clip 56. The clip 56 connects the debris chute drape 40 to the pole tip support 42. The clip 56 is, preferably, a carabiner. The pole tip support 42 has a protective cover 57 having slits 58 and a hole 59 so that the protective cover 57 can be reversibly placed over the support portion 50, the pole connecting portion 51, and the drape chute connection portion 54. The protective cover 51 protects against the pole tip support 42 from damaging a side of a house 43 and also helps the pole tip support 42 remain in place on the side of a house 43. FIG. 7 shows a perspective view of the pole tip support 42 in an assembled configuration with the drape support pole 41 screwed into the pole connecting portion 51 of the pole tip support 42.

Figure 8A:
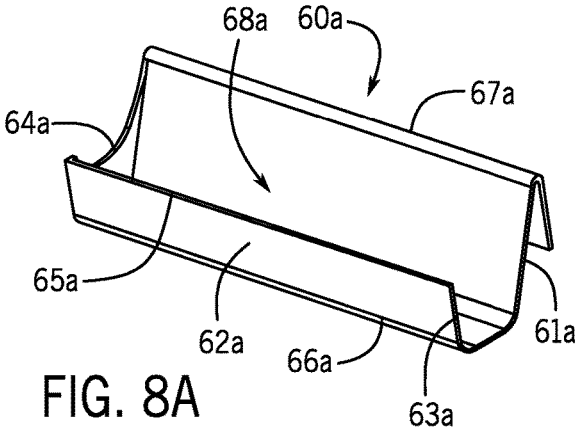
FIGS. 8*a*-8*c* show a rear perspective view of alternant embodiment of the gutter liner of FIG. 1.
Figure 8B:
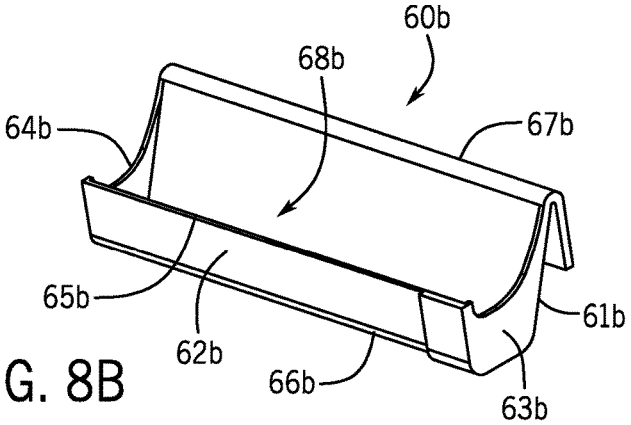
Figure 8C:
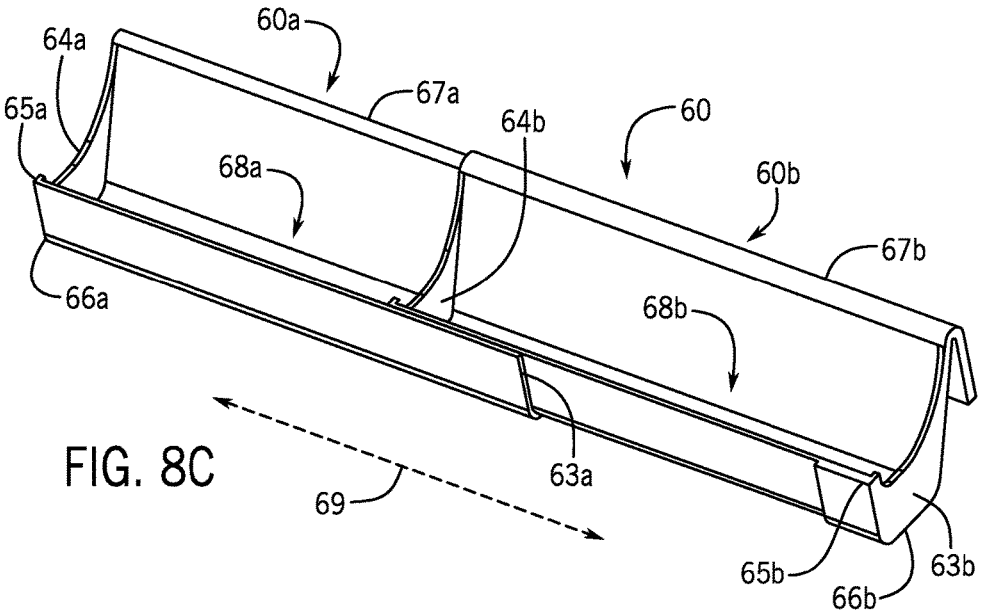

FIGS. 8*a*-8*c* show alternant embodiment gutter liner 10. FIG. 8*a* shows a first portion 60*a* and FIG. 8*b* a second portion 60*b*. As shown in FIG. 8*c* the portions 60*a* and 60*b* combine to form an adjustable gutter liner 60. The first portion 60*a* has a front side 61*a*, a rear side 62*a*, a first end 63*a*, a second opposite end 64*a*, a top 65*a*, and bottom 66*a*, a U-shaped or V-shaped lip 67*a* on the front side 61*a*, and an interior 68*a*. The second portion 60*b* has a front side 61*b*, a rear side 62*b*, a first end 63*b*, a second opposite end 64*b*, a top 65*b*, a bottom 66*b*, a U-shaped or V-shaped lip 67*b* on the front side 61*b*, and an interior 68*b*. The first end 63*a* of first portion 60*a* is open and the first end 63*b* of the second portion 60*b* is closed. FIG. 8*c* shows that the adjustable gutter liner 60 is formed when the second opposite end 64*b* of the second portion 60*b* is adjustably inserted into the interior 68*a* of the first portion 60*a* through the open first end 63*a* of the first portion 60*a*. Sections of the front side 61*b* and the rear side 62*b* of second portion 60*b* are positioned in the interior 68*a* of the first portion 60*a*. The U-shaped or V-shaped lip 67*b* of the second portion 60*b* is positioned over the U-shaped or V-shaped lip 67*a* of the first portion 60*a*. In this configuration gutter liner 60 is adjustable as the second portion 60*b* is inserted into or out of the first portion 60*a* to adjust the length of gutter liner 60 along the direction indicated by the dashed arrows 69. This adjustable feature facilitates positioning the gutter liner 60 between the mounting straps 34 in the gutter 30.

Figure 9:
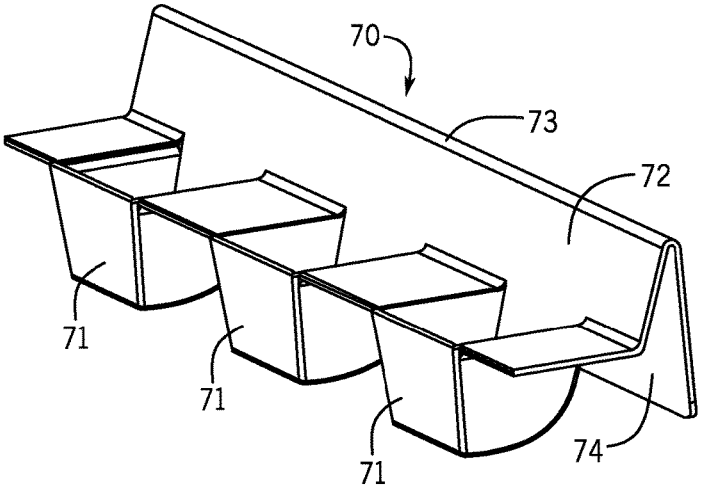
FIG. 9 shows a front perspective view of an alternate embodiment gutter liner.

FIG. 9 shows a front perspective view of an alternate embodiment gutter liner 70 having a plurality of spaced apart debris collecting cups 71. The debris collecting cups 71 are attached to a first side 72 of a U-shaped or V-shaped lip 73. An opposite side 74 of the U-shaped or V-shaped lip 73 is constructed to fit over a front side 31 of a gutter 30 (see FIGS. 3 and 4).

Figure 10:
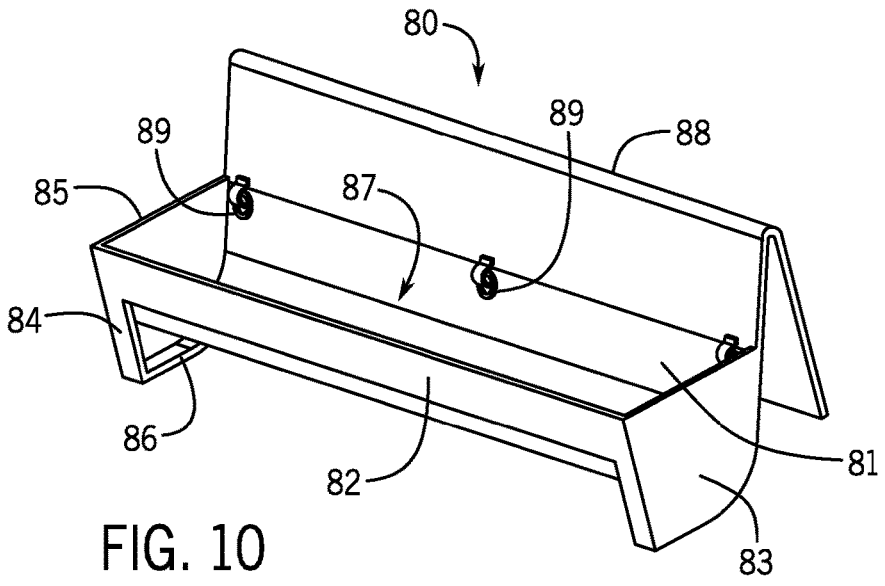
FIG. 10 is an illustration of a debris collection tarp having handles attached thereto.

FIG. 10 shows a front perspective view of an alternate embodiment gutter liner 80. The gutter liner 80 has a front side 81, a rear side 82, a first end 83, a second opposite end 84, a top 85 and a bottom 86, defining an interior 87. A lip 88, preferably a U-shaped or V-shaped lip 17, extends from the front side 81 and from the top 85. One or more connectors 89, such as rings, are positioned in the interior 87 on front side 81 near top 85. The connectors 89 are useful for attaching debris chute drapes 40, for example, to the gutter liner 80, if desired.

Figure 11:
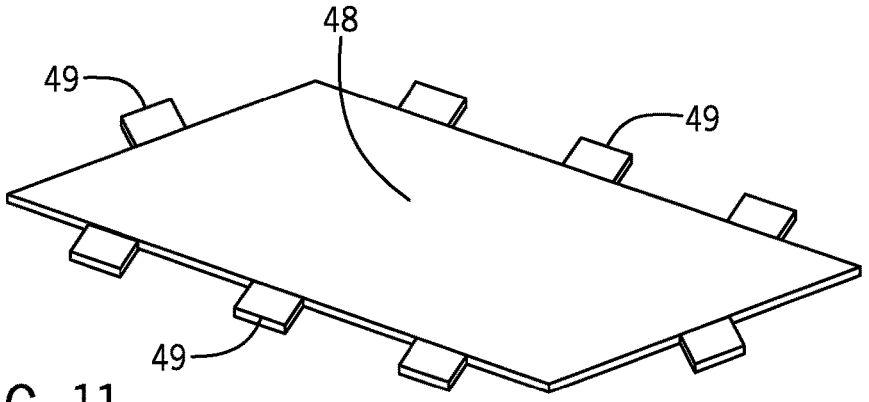
FIG. 11 shows a front perspective view of another alternate embodiment gutter liner.

FIG. 11 shows an illustration of a debris collection tarp 48 having handles 49 attached thereto. Although the debris collection tarp 48 is shown as rectangular, it can be any desired shape. The handles 49 make a fully loaded debris collection tarp 48 relatively easy to carry and to empty into truck bed, for example.

Figure 12:
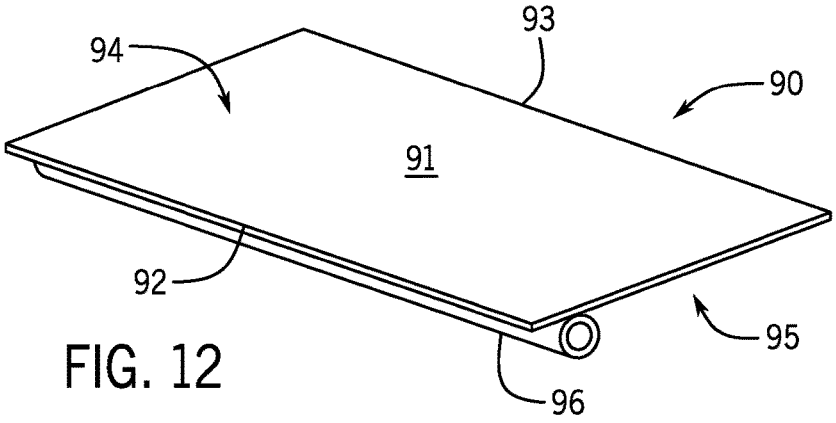
FIG. 12 shows a top perspective view of a gutter cover having a cover plate and a brace member for use adjacent to a gutter liner.

The gutter liners of the present invention can be used adjacent to a gutter cover which directs roofing debris from a roof, over a gutter, and directly onto a debris chute drape. FIG. 12 shows a top perspective view of a gutter cover 90 to direct roofing debris over a gutter and onto a debris chute drape 40. The gutter cover 90 consists of a cover plate 91 having a front end 92, a rear end 93, a top surface 94, and a bottom surface 95. A brace member 96 is attached along the length of the cover plate 91 near the front end 92. The front end 92 extends beyond the brace member 96.

Figure 13:
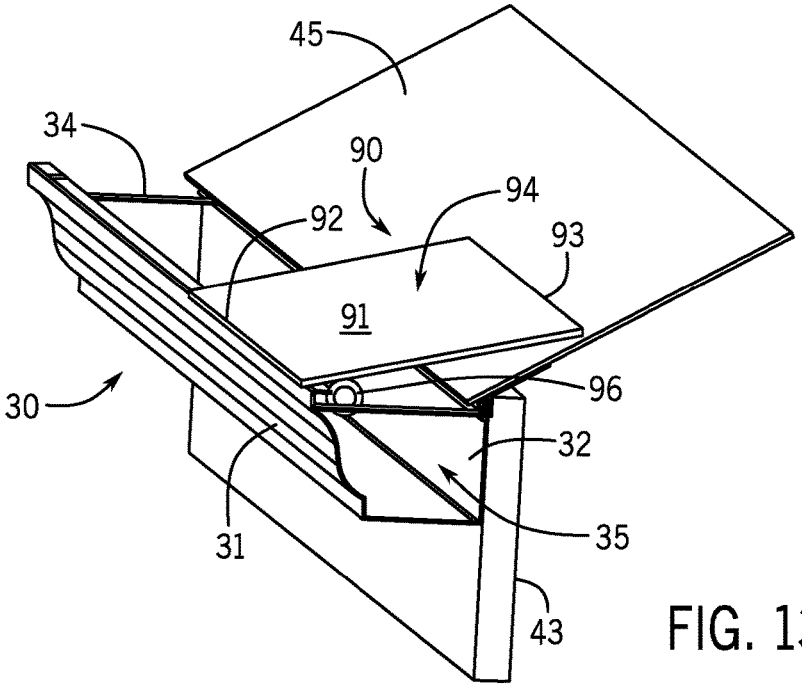
FIG. 13 shows a top perspective view of the gutter cover positioned over a gutter on a house.

FIG. 13 shows the gutter cover 90 positioned over a gutter 30 on a house 43. The brace member 96 is in the interior 35 of gutter 30 engaging the front side 31 of the gutter 30. The front end 92 of the cover plate 91 extends beyond the front side 31 of the gutter 30 and the rear end 93 of the cover plate 91 rests upon the roof 45 of the house 43. As roofing debris falls down a roof onto the cover plate 91 it will fall off the front end 92 onto a debris chute drape 40.

Figure 14:
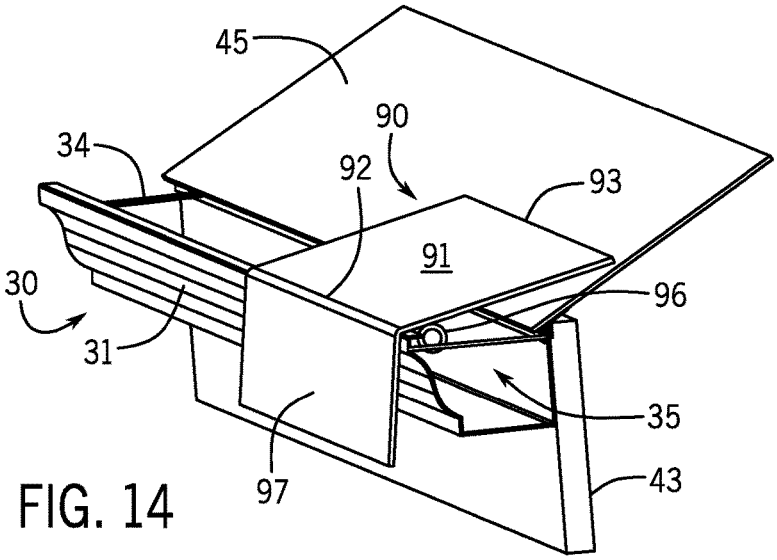
FIG. 14 shows a top perspective view of the gutter cover having a debris guide plate attached at a front end of the cover plate.

FIG. 14 shows that the gutter cover 90 can have a debris guide plate 97 attached at the front end 92 of the cover plate 91 at an angle. The angle of the guide plate 97 is optimized to further guide roofing debris from the cover plate 91 onto a debris chute drape 40.

Figure 15:
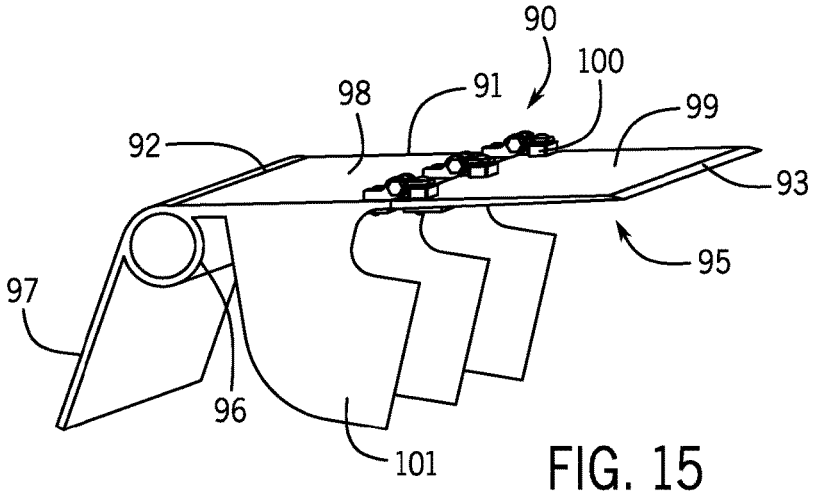
FIG. 15 shows a side perspective view of the gutter cover having a flexible cover plate and support members on its bottom surface.

FIG. 15 shows that the gutter cover 90 can have a flexible cover plate 91 to conform to the angle of the roof 45. The gutter cover 90 can be split into a first portion 98 and a second portion 99 connected rotatably to each other with hinges 100, for example. The gutter cover 90 can also have support members 101 on its bottom surface 95 for insertion into the interior 35 of gutter 30.

A method for collecting roofing debris includes inserting one or more gutter liners into an interior of a gutter attached to a roof, positioning one or more debris chute drapes vertically on one or more poles adjacent the gutter; allowing roofing debris to accumulate in the one or more gutter liners; allowing roofing debris to fall on to one or more debris chute drapes; allowing roofing debris to fall from the one or more debris chute drapes onto the ground; and collecting the roofing debris from the gutter liners and from the ground. The gutter liners are inserted into a gutter so that the lip of the gutter liner extends over the front of the gutter. The gutter liners are arranged so that a support member on the first end of the gutter liner and the support member on the second opposite end of the gutter liner fit over a mounting strap of a gutter. Also, the support member on the first end of the gutter liner fits over the support member on the second opposite end of an adjacent gutter liner or is positioned adjacent to it.

With the alternant embodiment gutter liner 60, the two gutter liner portions 60*a* and 60*b* are combined, adjusted to the desired length, and inserted into the gutter. With the alternant embodiment gutter liner 80, it is simply inserted into the gutter and debris chute drapes can be attached to the connectors in the gutter liner 80. With the alternant embodiment gutter liner 90, it is simply inserted into the gutter. Gutter covers 90 can be used in place of gutter liners or they can be used in combination with gutter liners.

Drape support poles are placed vertically at an angle at desired intervals around the perimeter of a building, adjacent to the gutters on the building. A first end of the drape support pole is placed on a side of the building near the gutter and a second opposite end is placed on the ground, with the drape support pole angled away from the side of the building. Debris chute drapes are draped over the support poles and are connected to the first end of the drape support pole, preferably to a pole tip support on the first end of the drape support pole. The drape support poles angles the debris chute drapes away from the side of the building.

As roofing debris accumulates on the roof of the building it is allowed to fall down the slope of the roof into the gutter liner positioned in the interior of the gutter. The roofing debris is also allowed to fall off the roof and onto the debris chute drapes. Because the debris chute drapes are angled away from the side of the building due to the angle of the drape support poles, the roofing debris slides down the debris chute drapes and on to the ground. There is, preferably, a tarp on the ground to collect the roofing debris from the debris chute drapes. The tarp, preferably, has handles. The gutter liners with debris are collected from the gutters and the tarp on the ground with debris is picked up. The debris in the gutter liners and the tarp is then emptied into any desired receptacle for removal. The debris chute drapes guide roofing debris away from the side of the building and, thus, protect the side of the house and objects near the side of the house from any damage that might be caused by the roofing debris.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the gutter liners can made in any size and from any suitable materials. The drape support poles can be constructed in any size and strength and be connected by any suitable means to a pole tip support. The debris chute drapes can be of any suitable size and material and can be flexible or inflexible. The roofing debris collecting apparatus of the present invention can be adapted to any type of roof and building.

It will be understood that various changes in the details, materials, and arrangements of the parts which have been described and illustrated above in order to explain the nature of this invention may be made by those skilled in the art without departing from the principle and scope of the invention as recited in the following claim.

We claim:

1. A roofing debris collection apparatus, comprising:

a) one or more gutter liners constructed to fit in an interior of a gutter;

b) one or more debris chute drapes;

c) one or more drape support poles maintaining said debris chute drapes in a vertical orientation adjacent said gutter;

d) said gutter liner having a support member on a first end of said gutter liner and a support member on a second opposite end of said gutter liner, each said support member constructed to fit over a mounting strap of a gutter.

2. The roofing debris collection apparatus of claim 1 wherein said support member on said first end of said gutter liner is constructed to fit over said support member on said second opposite end of an adjacent gutter liner.

3. The roofing debris collection apparatus of claim 1 further comprising said drape support poles having a pole tip support for engaging the side of a building.

4. The roofing debris collection apparatus of claim 3 wherein said pole tip support comprises a support portion having a pole connecting portion and a chute drape connecting portion.

5. The roofing debris collection apparatus of claim 3 wherein said pole tip support further comprises a protective cover.

6. The roofing debris collection apparatus of claim 1, further comprising a debris collecting tarp having handles.

7. The roofing debris collection apparatus of claim 1, further comprising a gutter cover.

8. A roofing debris collection apparatus, comprising:

a) one or more gutter liners constructed to fit in an interior of a gutter;

b) one or more debris chute drapes;

c) one or more drape support poles maintaining said debris chute drapes in a vertical orientation adjacent said gutter;

d) said gutter liner having a U-shaped or V-shaped lip on a top portion of said liner, said U-shaped or V-shaped lip constructed to fit over a top portion of a gutter; and e) said gutter liner having a support member on a first end of said gutter liner and a support member on a second opposite end of said gutter liner, each said support member constructed to fit over a mounting strap of a gutter.

9. The roofing debris collection apparatus of claim 8 wherein said support member on said first end of said gutter liner is constructed to fit over said support member on said second opposite end of an adjacent gutter liner.

10. The roofing debris collection apparatus of claim 8, further comprising said drape support poles having a pole tip support for engaging the side of a building.

11. The roofing debris collection apparatus of claim 10 wherein said pole tip support comprises a support portion having a pole connecting portion and a chute drape connecting portion.

12. The roofing debris collection apparatus of claim 11 wherein said pole tip support has a protective cover.

13. The roofing debris collection apparatus of claim 8, further comprising a debris collecting tarp having handles.

14. The roofing debris collection apparatus of claim 8, further comprising a gutter cover.

15. A roofing debris collection apparatus, comprising:

a) one or more gutter liners constructed to fit in an interior of a gutter;

b) one or more debris chute drapes;

c) one or more drape support poles maintaining said debris chute drapes in a vertical orientation adjacent said gutter;

d) said gutter liner having a U-shaped or V-shaped lip on a top portion of said liner, said U-shaped or V-shaped lip constructed to fit over a top portion of a gutter; and e) said gutter liner having a support member on a first end of said gutter liner and a support member on a second opposite end of said gutter liner, each said support member constructed to fit over a mounting strap of a gutter, wherein said support member on said first end of said gutter liner is constructed to fit over said support member on said second opposite end of an adjacent gutter liner; and f) said drape support poles having a pole tip support for engaging the side of a building.

16. The roofing debris collection apparatus of claim 15 wherein said pole tip support comprises a support portion having a pole connecting portion and a chute drape connecting portion.

17. The roofing debris collection apparatus of claim 16 wherein said pole tip support further comprises a protective cover.

18. The roofing debris collection apparatus of claim 15, further comprising a debris collecting tarp having handles.

19. The roofing debris collection apparatus of claim 15, further comprising a gutter cover.

20. A roofing debris collection apparatus, comprising:

a) one or more gutter liners constructed to fit in an interior of a gutter;

b) one or more debris chute drapes;

c) one or more drape support poles maintaining said debris chute drapes in a vertical orientation adjacent said gutter;

d) said gutter liner being adjustable and having a first portion with a U-shaped or V-shaped lip on a top of said first portion and having a second portion with a U-shaped or V-shaped lip on a top of said second portion, wherein said second portion is adjustably inserted into said first portion and said U-shaped or V-shaped lip on said second portion fits over said U-shaped or V-shaped lip on said first portion;

e) said U-shaped or V-shaped lips constructed to fit over a top edge of a gutter; and f) said drape support poles having a pole tip support for engaging the side of a building, wherein said pole tip support comprises a support portion having a pole connecting portion and a chute drape connecting portion.

21. The roofing debris collection apparatus of claim 20 wherein said pole tip support further comprises a protective cover.

22. The roofing debris collection apparatus of claim 20, further comprising a debris collecting tarp having handles.

23. The roofing debris collection apparatus of claim 20, further comprising a gutter cover.

* * * * *